US005110235A

United States Patent [19]

Thomann et al.

[11] Patent Number: 5,110,235

[45] Date of Patent: May 5, 1992

[54] LOCKING COMPONENT FOR SECURING A COVER ON A FRAME

[75] Inventors: Roland Thomann, Langnau; Heinz Witschi, Adlingenswil, both of Switzerland

[73] Assignee: ABT, Inc., Troutman, N.C.

[21] Appl. No.: 527,068

[22] Filed: May 22, 1990

[30] Foreign Application Priority Data

May 25, 1989 [CH] Switzerland ..... 1972/89

[51] Int. Cl.[5] ..... E01C 11/22; E05C 21/02

[52] U.S. Cl. ..... 404/4; 49/465

[58] Field of Search ..... 404/4, 5; 52/20; 49/465, 463

[56] References Cited

U.S. PATENT DOCUMENTS 4,257,193 3/1981 Williams ..... 49/465
4,594,157 6/1986 McGowan ..... 404/4 X
4,621,939 11/1986 Thomann et al. ..... 404/5 X
4,761,319 8/1988 Kraus et al. ..... 49/465 X
4,955,752 9/1990 Ferns ..... 404/4 X
4,964,755 10/1990 Lewis et al. ..... 49/465 X

FOREIGN PATENT DOCUMENTS 470992 8/1937 United Kingdom ..... 404/5

*Primary Examiner*—William P. Neuder
*Attorney, Agent, or Firm*—Bell, Seltzer, Park & Gibson

[57] ABSTRACT

The invention comprises a grate having a device to prevent it from dislodging when a vehicle drives over the grate. For this purpose, a part (2') of the supporting component at a side face of the grate (1) is designed as a thin, tongue-shaped wall (33) with an outer thickening (34). The supporting component has a notch (35) that is vertical with respect to its longitudinal axis on an end of the tongue-shaped wall, a thickening (22) or a depression being located on an inner side face of the associated supporting frame.

10 Claims, 10 Drawing Sheets

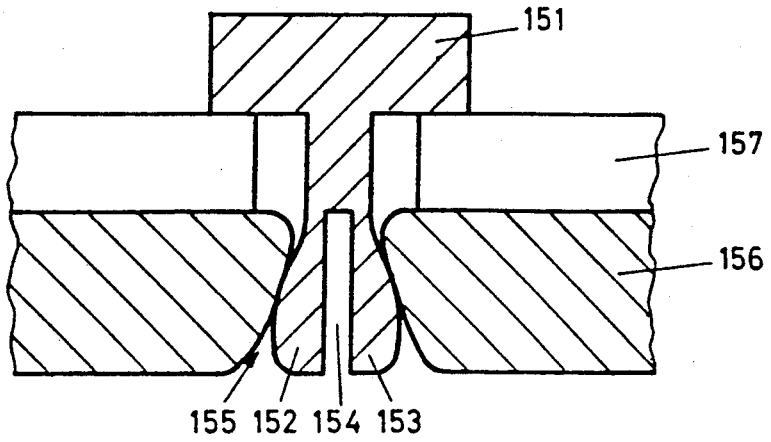
Fig. 15
Fig. 16
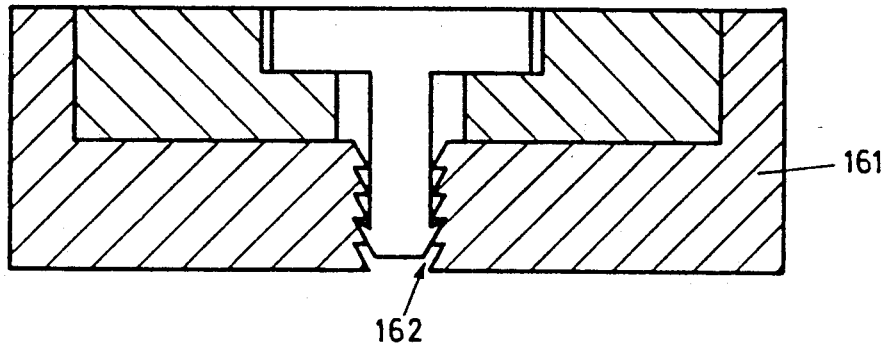
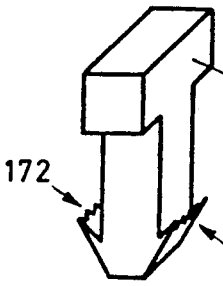
Fig. 17
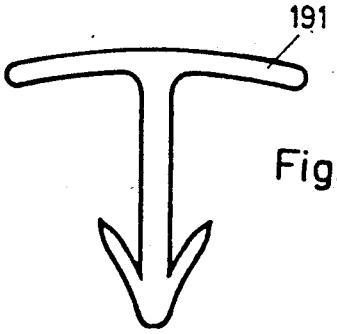
Fig. 19
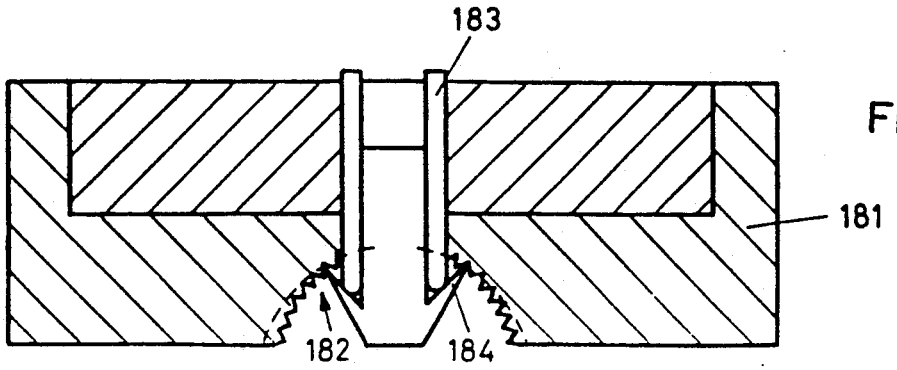
Fig. 18

Fig.20
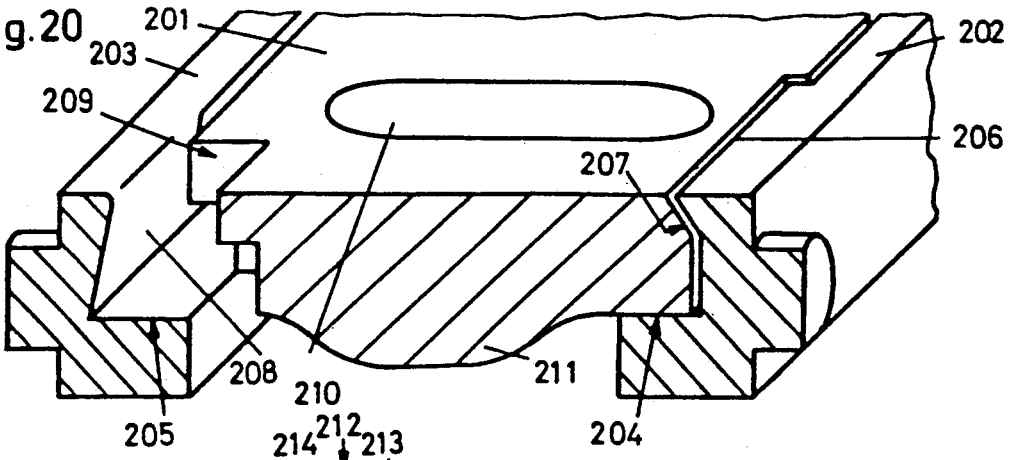
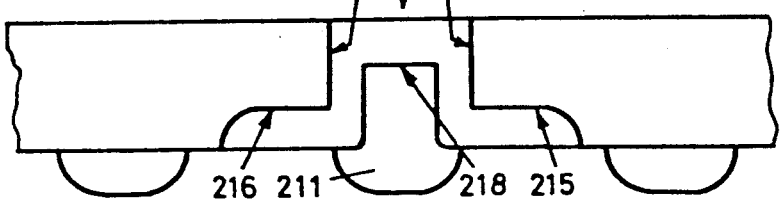
Fig. 21
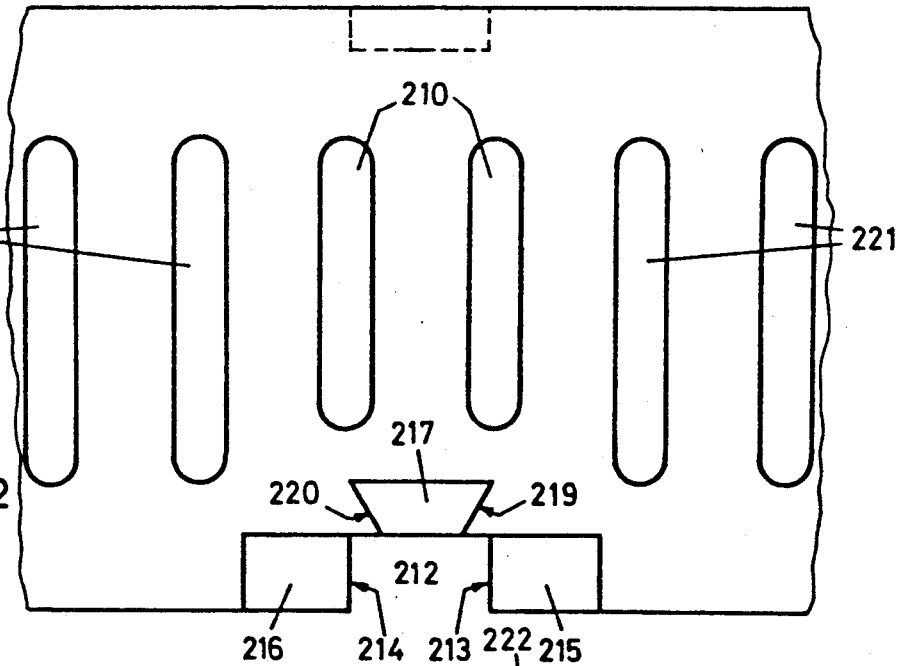
Fig.22
Fig. 23
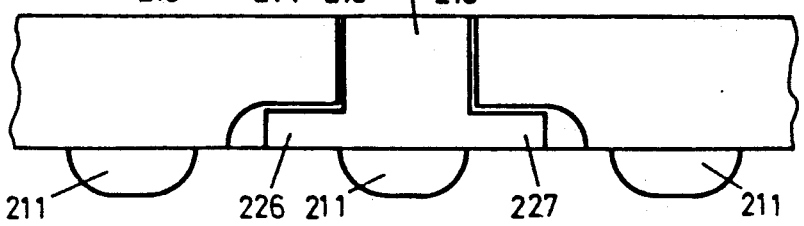

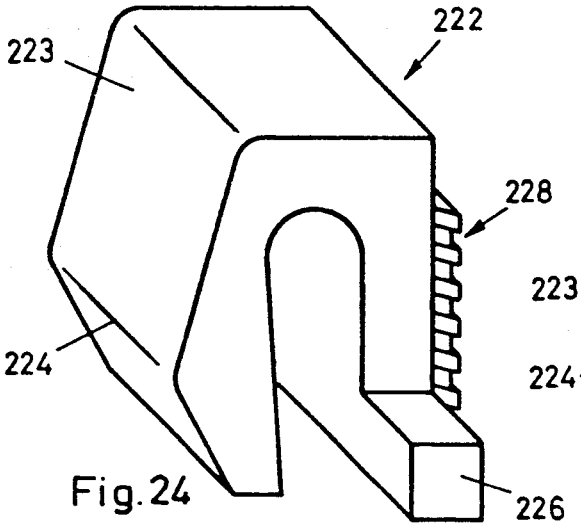
Fig. 24
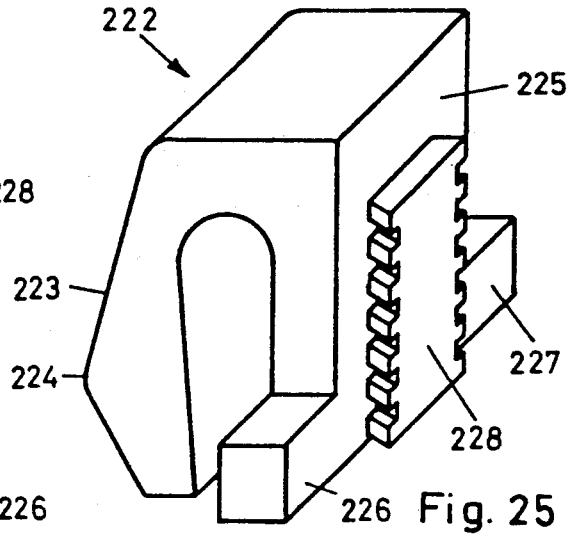
Fig. 25
Fig. 26
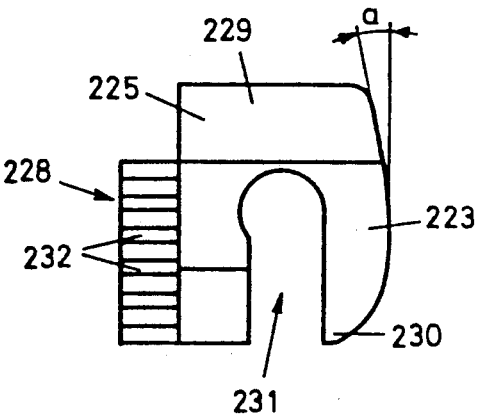
Fig. 27
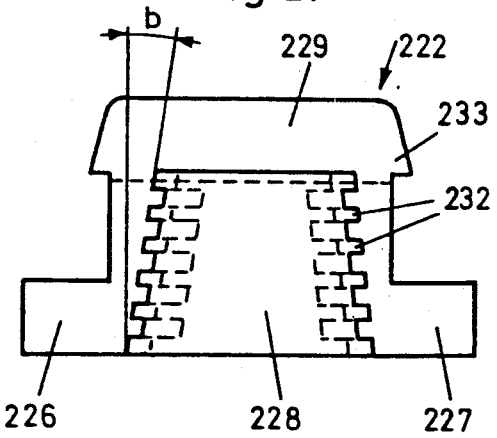
Fig. 28
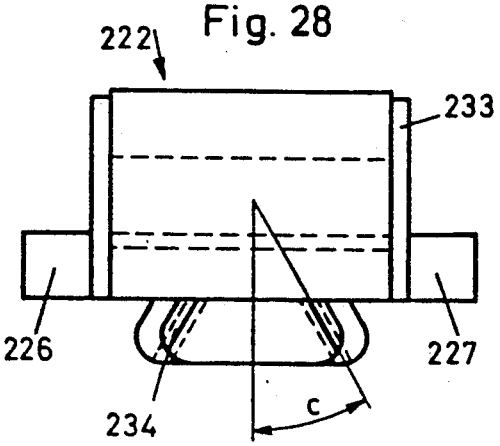

LOCKING COMPONENT FOR SECURING A COVER ON A FRAME

FIELD OF THE INVENTION

The present invention relates to a grate and frame of the type suitable for outdoor use wherein the grate includes a plurality of inlet slots through which water can flow and wherein the grate is provided with a means for locking to the frame the introductory part of patent claim 1, preferably for securing a cover as described in claim 6 on a frame as described in claim 10.

SUMMARY OF THE INVENTION

The invention provides in combination a generally rectangular grate of the type suitable for outdoor use and which includes a plurality of inlet slots through which water can flow and a cooperating frame which includes interior vertical side walls and horizontal bottom walls for supportably receiving the plate. There is at least one projection located on at least a portion of an interior vertical side wall. The grate comprises a cut out portion on at least one side face thereof and there is a locking component mounted in the cut out portion. The locking component comprises at least one tongue shaped wall and is positioned at a location corresponding to the location of the projection on the side wall of the frame so that the grate can be clamped into the frame by the cooperating action of the locking component in the grate side wall and the projection on the side wall of the frame.

The object of the present invention is to devise a locking component for a cover that can be fabricated with a minimum of engineering and that is suitable for outdoor use.

In a further development of the invention, the locking component can have a support plate that rests on the outer surface of the wall provided with the extensions.

The support plate can also have two main edges that run parallel to the plane of symmetry of the locking component or that form an angle such that the angle bisector is located in a plane that is parallel to the plane of symmetry of the locking component.

The locking component can also be designed so that at least one of the two main edges is directed diagonally with respect to the surface of the wall on which it rests in order to form a dovetail ramp.

With this kind of locking component, the surfaces of the extensions that are not parallel to the surface of the corresponding wall, and/or the main edges of the support plate can be toothed at least in part. In addition, the wall that is not provided with these extensions can have an external thickening that runs parallel to the longitudinal axis of the locking component and is located in the area between the middle of the wall and the opening of the locking component.

In a further development of the invention, a cover can be provided to be secured with the invented locking component on a frame, the edge of the cover having a groove into which the locking component can be inserted laterally and project in part.

In a further development of the invention, a frame can be provided in order to secure a cover thereon by means of a locking component according to the invention, the edge of the frame (3) having a space (8) into which the thickening of the wall not provided with the extensions can be clamped.

In a further embodiment of the invention, the cover or grate can have a through-hole (7, 8) in the area of the tongue-shaped wall (33).

The frame or a supporting frame can be designed so that the thickening (52, 62) is located on the outer side of a tongue-shaped wall (51, 61) and/or so that the tongue-shaped wall (51, 61) is separated from the supporting frame (2') by slots (53; 63; 54, 55) all around, so that the tongue-shaped wall (51, 61) is connected with the supporting frame (2') on only one side

BRIEF DESCRIPTION OF THE DRAWINGS

The invention is explained in more detail as an example below using a drawing.

FIG. 15 and 16 are further sectional views of other variants of such a locking component.

FIG. 17 is a perspective view of another locking component according to the invention.

FIG. 18 is a sectional view of a locking component according to FIG. 17 in the mounted condition.

FIG. 19 is a sectional view of a T-shaped locking component with a flexible crossbar.

FIG. 20 is a perspective sectional view of a supporting frame and of a grate with a groove for insertion of a locking component according to the invention.

FIG. 21 is a side view of the grate in the area in which this groove is located.

FIG. 22 is a view of the grate from the bottom in the area in which this groove is located.

FIG. 23 is a side view of a part of the grate with mounted locking component according to the invention.

FIGS. 24 and 25 are perspective views of such a locking component from the front and from the back.

FIGS. 26, 27 and 28 are views of a further embodiment of the locking component according to the invention from the side, from the back, and from the front.

DETAILED DESCRIPTION OF THE INVENTION

Figure 1:
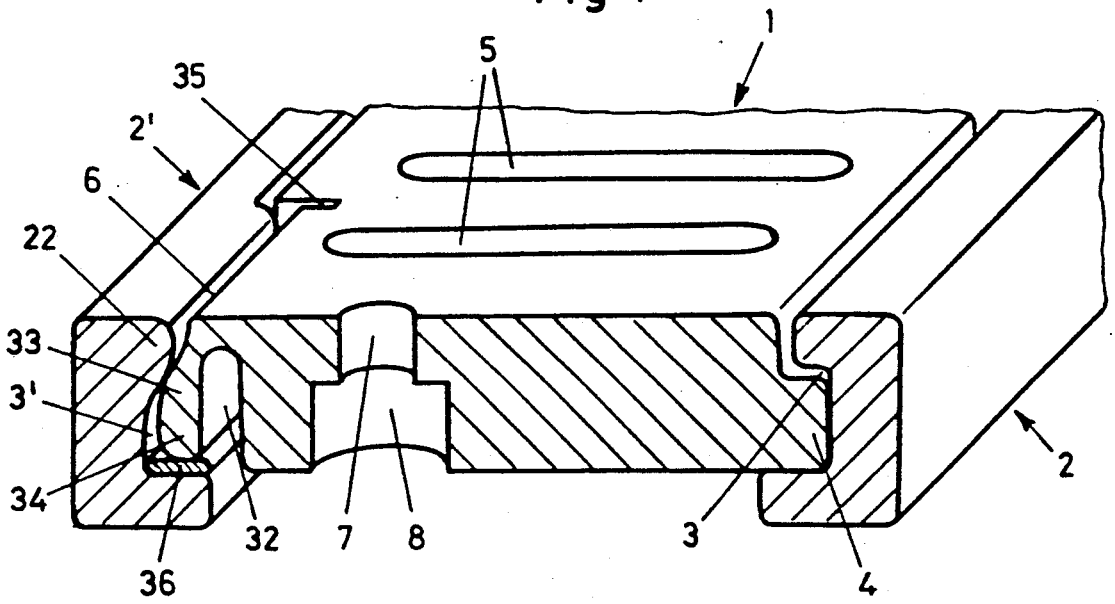
FIG. 1 is a view in perspective sectional view of a grate according to the invention.

The grate 1 according to FIG. 1 is mounted in a supporting frame with two frame parts 2, 2', the frame part 2 having an at least approximately oblong cut-out 3 that is engaged by a guide rib or a projection 4 of the grate. The other frame part 2' has an oblong cut-out 3' into which an oblong form-fitting projection of the grate is inserted; in FIG. 1, only part of this projection is visible as a thin tongue-shaped wall 33. The wall 33 is supported through a pad 36 (FIG. 1) by the frame part 2', but this pad can be eliminated if the weight of the grate exerts a load only on the other parts of the supporting frame.

Figure 2:
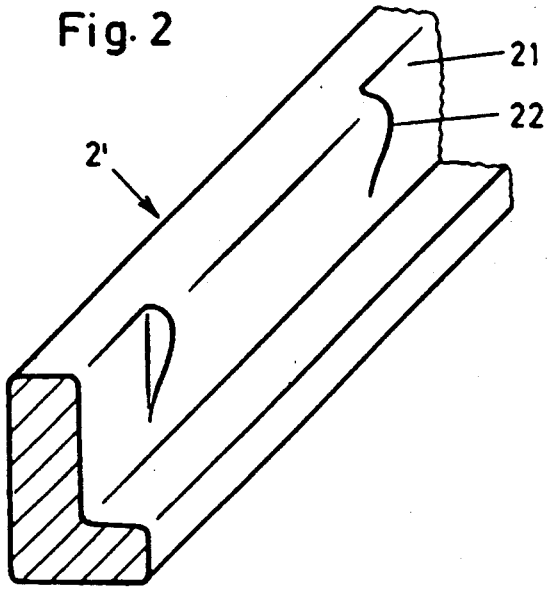
FIG. 2 is a perspective view of a part of an associated supporting frame.
Figure 3:
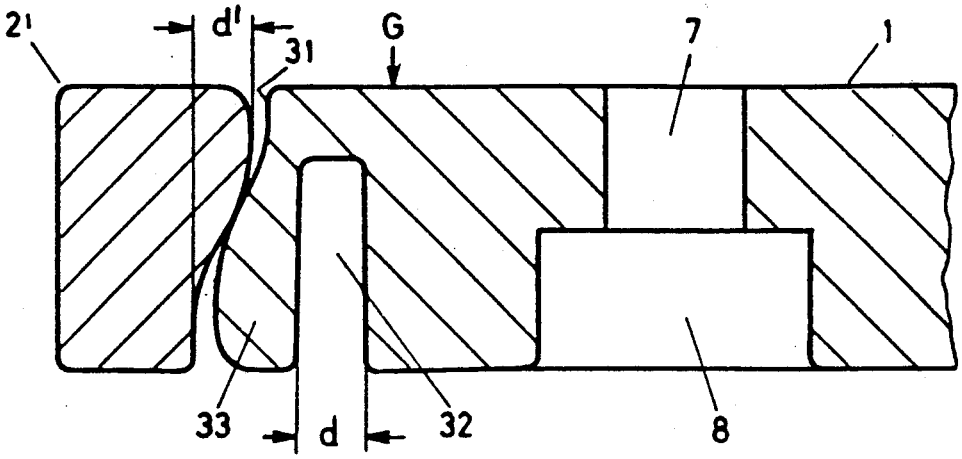
FIG. 3 is a schematic sectional view of the contact surface between the grate and the supporting frame.
Figure 4:
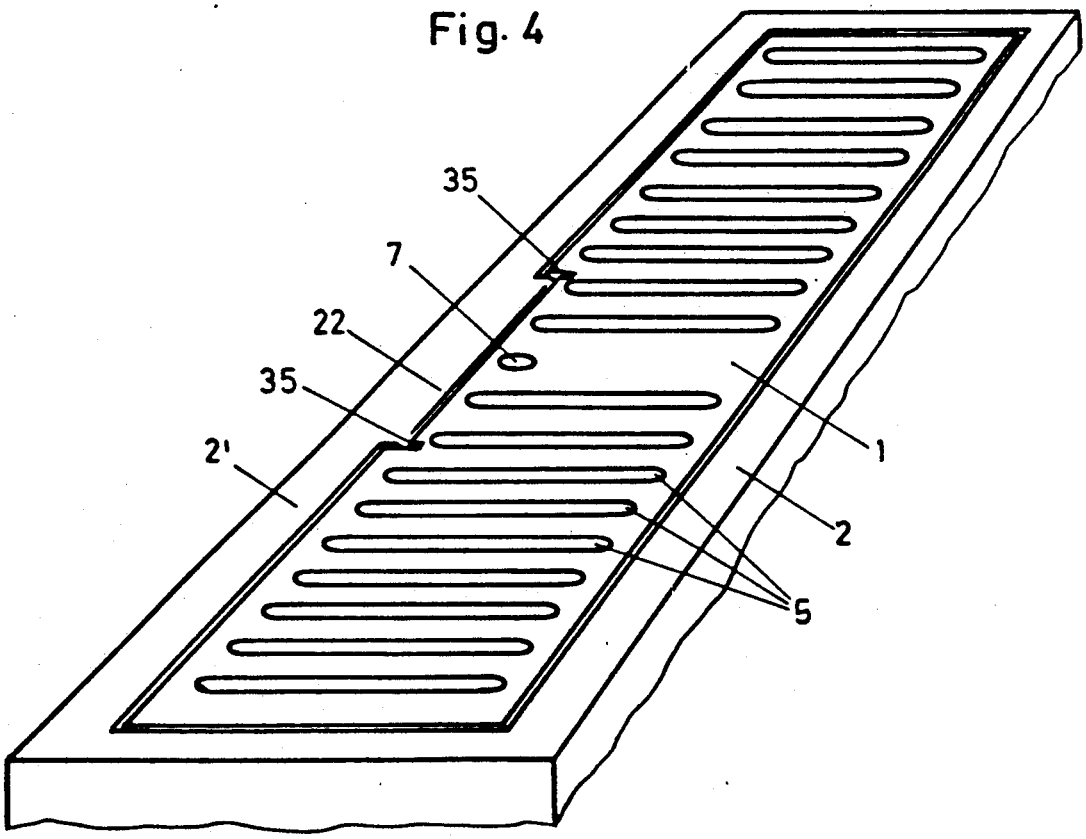
FIG. 4 is a perspective view of the grate according to FIG. 1 in the mounted condition.

The grate 1 is provided with inlet slots 5 through which the water can flow. The upper part of an inner vertical surface 21 (FIG. 2) of the frame part 2' has an elongated, rounded off thickening 22 with a length t, which could also be a burl-like elevation. This thickening 22, which extends at most to the upper corner edge of the frame part 2', is associated with an elongated taper 31 (FIG. 3) at the upper edge 6 (FIG. 1) of the grate 1, the length T of the taper 31 being greater than the length t. The thickening 22 of the supporting frame and the taper 31 of the grate are adjusted to each other (FIG. 4) so that they form a closure. For this purpose, the underside of the grate 1 has a narrow slot 32 running parallel to the edge 6 and placed so close to the edge of the grate that the thin, tongue-shaped wall 33 is formed between this edge and the slot 32 and extends between two notches running vertical to the longitudinal axis of the supporting components, FIG. 1 showing only one notch 35.

The grate also has two concentrically communicating holes 7 and 8, the upper one having the smaller diameter.

The grate with the closure according to FIG. 1 functions as follows:

The maximum heights d' and d'' of the thickening 22 and the thickening 33 relative to the vertical air gap between the grate and the supporting frame are about the same, and d' can generally be either somewhat greater or somewhat smaller than d''. The width d of the slot 32, on the other hand, must be greater than the height d' or d''. For mounting the grate according to FIG. 1, the projection 4 is first inserted into the cut-out 3 of the frame part 2, the bottom part of the wall 33 resting on the thickening 22. The grate is then pressed downward with a high degree of force G (FIG. 3) on the side where the wall 33 is located, which causes the wall 33 to be slipped into the slot 32; this is possible because both the upper part of the thickening 22 and the bottom part of the wall 33 are wedge-shaped and/or rounded off. The grate can thus be pressed entirely into the supporting frame, and if the grate consists of a relatively flexible material, the wall or tongue 33 will return to about the original position and the grate will remain clamped in the supporting frame. For disassembly or to pull the grate out, an anchor can be mounted at the holes 7, 8 and pulled by means of a cable to unclamp the grate with a high degree of force.

Figure 5:
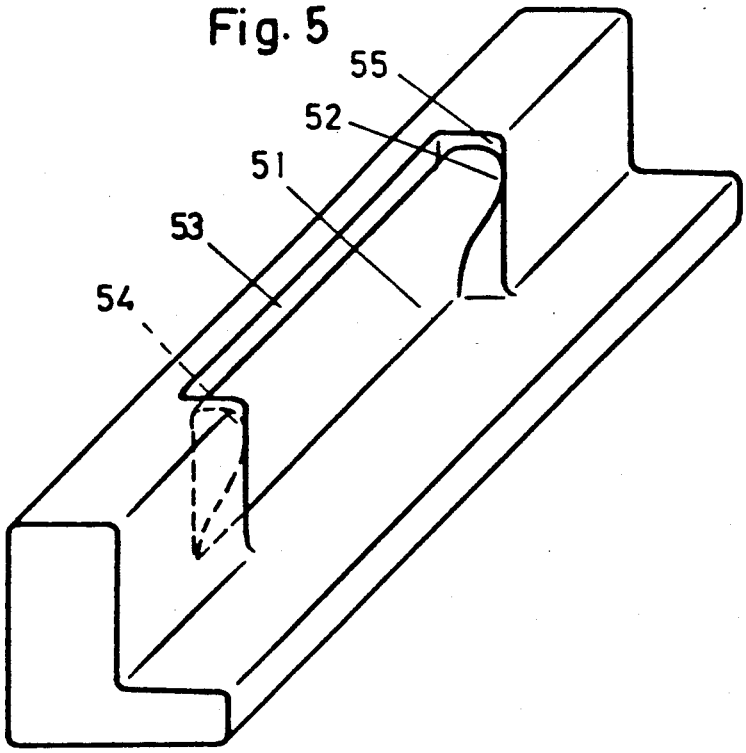
FIG. 5 is a perspective view of the supporting frame in another embodiment of the invention.
Figure 7:
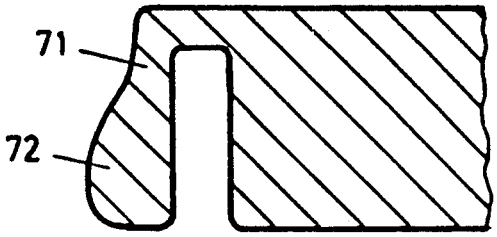
FIG. 7 is a sectional schematic view of the associated grate.
Figure 8:
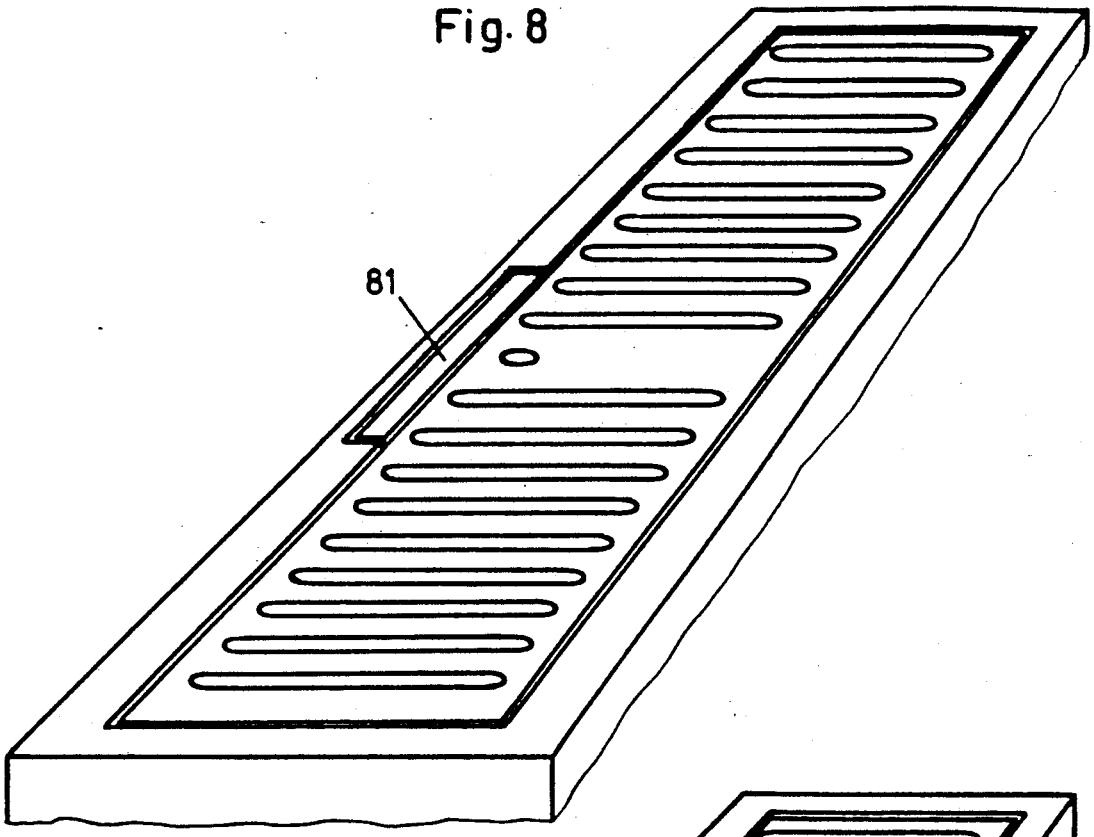
FIG. 8 is a perspective view of the grate according to FIG. 7 in the mounted condition.
Figure 9:
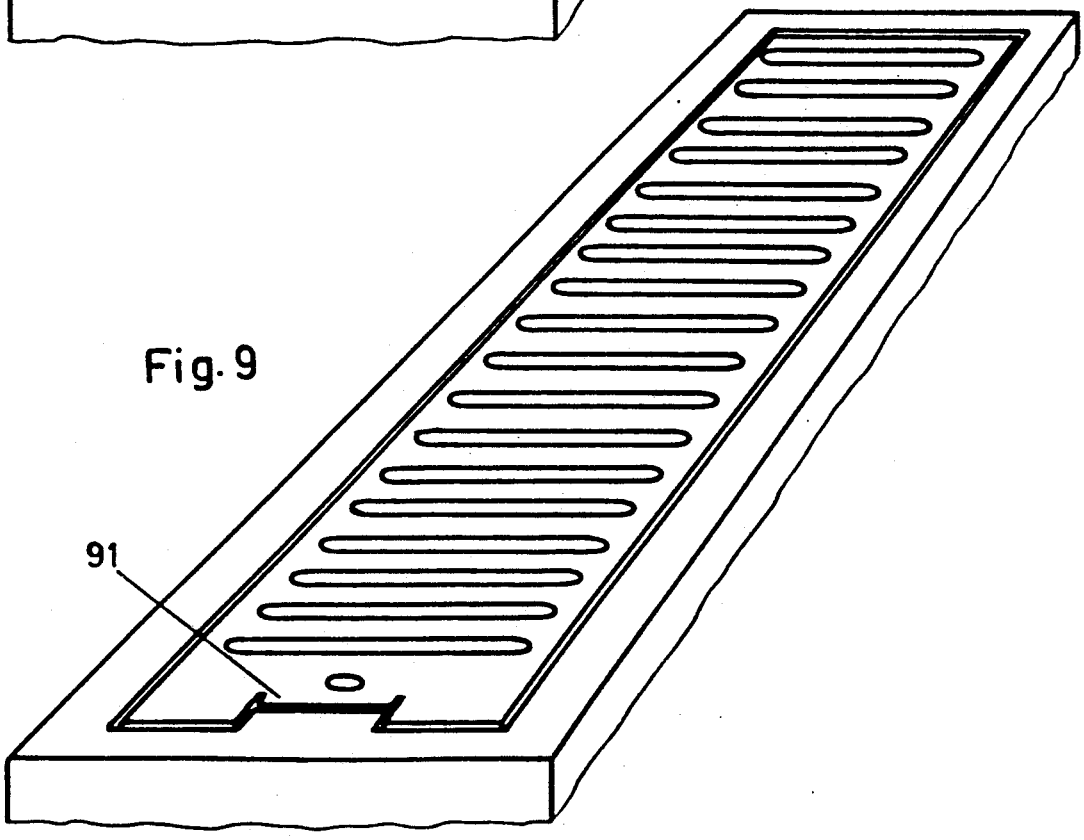
FIG. 9 is a perspective view of another embodiment of a grate according to the invention.

In a further development of the invention, the supporting frame can also be provided with a tongue 51. FIG. 5 gives an example of such an embodiment in which the tongue 51, which also has a thickening 52 and 62 (FIG. 6), is separated from the supporting frame by slots 53, 63 and 54, 55 all around, so that the tongue 61 (FIG. 6) is connected with the supporting frame only at its underside. This is also illustrated in FIG. 8 by the tongue 81. In such a case, the grate can also have a tongue 71 (FIG. 7) or not. FIG. 9 shows an embodiment in which the lock 91 is provided on a narrow side of the grate.

A further embodiment of the invention consists in a frame as sketched in FIG. 5, but without slots 53, 54, 55. In this case, the grate is not to have any taper 31 on the edge 6, rather only a thickening 72 (72) on the bottom part of the tongue 71. To simplify the figures, the outer walls of the supporting frame are shown as being smooth. The outer parts of the supporting frame can, of course, be provided with indentations, projections, holes and cut-outs of any kind that can be used to anchor the frame.

Figure 6:
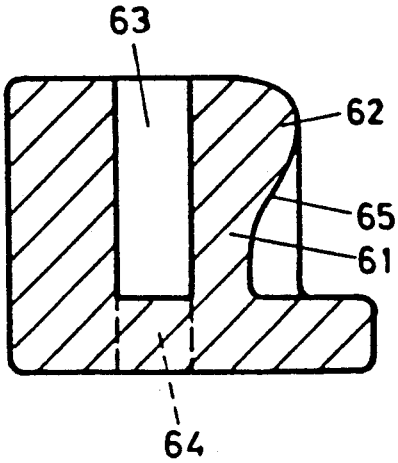
FIG. 6 is a sectional view transverse to a supporting frame piece according to FIG. 5.

The slot 63 in a version according to FIG. 6 can be connected with holes 64 to facilitate washing the slot 63 out. The slot 63 can be covered over with a form-fitting piece.

The figures show tongues 33, 51, 61 made of solid material. It would also be possible, however, to weld on or bolt on tongues that are separate and, if necessary, made of a more flexible material.

It should be noted finally that the tongue-like wall 61 can also have a thickening 62 combined with an indentation 65 (FIG. 6).

Instead of the flexible component on the grate, the grate itself could also be rigid, and the moving tongue 51 (FIG. 5) could, as mentioned, be mounted on the frame.

Figure 10:
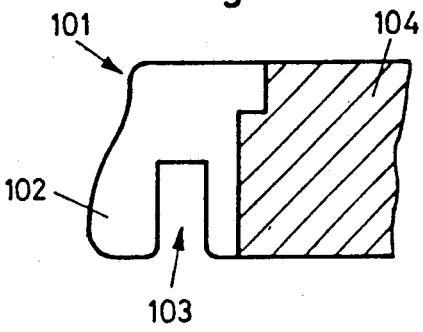
FIG. 10 is a schematic view of an insertable locking component according to the invention.

The clamping plug 101 with a tongue-shaped wall 102 and a slot 103 shown in FIG. 10 is designed as a separate lock part that can be inserted into a corresponding cut-out of a channel cover 104 in order to form a unit such as is shown in FIG. 1. The advantage of this kind of clamping pin is that it can be made of a material that is more suitable for its function than that of the channel cover.

Figure 11:
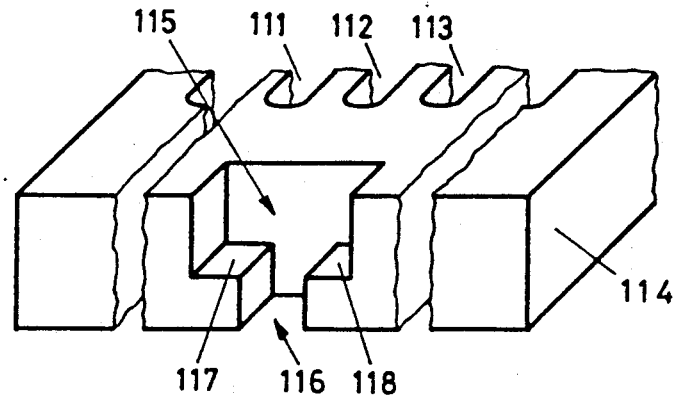
FIG. 11 is a perspective partial view of a cover with a recess for a further variant of the locking component according to the invention.

The grate provided with inlet slots 111, 112, 113 or the channel cover 114 in FIG. 11 has an elongated cut-out 115 on one edge that communicates with a narrower opening for passage 116. The opening 116 and the cut-out 115 are centered so as to form two shoulders or projections 117 and 118.

Figure 12:
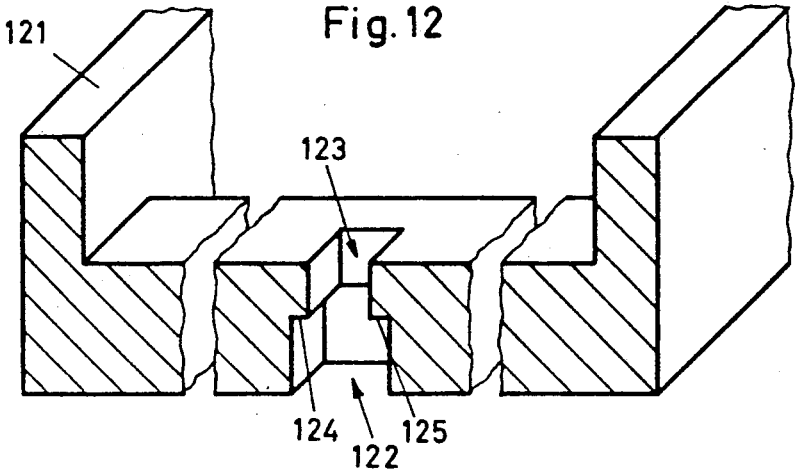
FIG. 12 is a perspective partial view of the associated frame.

The supporting frame 121 shown in part in a sectional view in FIG. 12 also has an elongated cut-out 122 on one of its edges that communicates at the top with a narrower opening for passage 123. The opening 123 and the cut-out 122 are also centered so as to form two shoulders or projections 124 and 125 as well.

Figure 13:
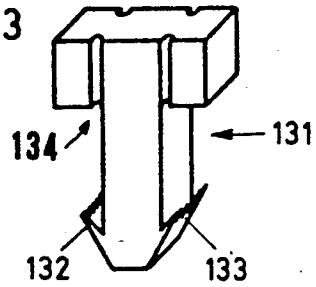
FIG. 13 is a perspective view of a locking component according to the invention.

The spreading anchor 131 shown in FIG. 13 is basically T-shaped, but has two laterally arranged, upwardly spread tongues 132 and 133 on the bottom part of its vertical leg. The horizontal bar of the spreading anchor 131 is form-fitting with the cut-out 115 of the channel cover 114.

Figure 14:
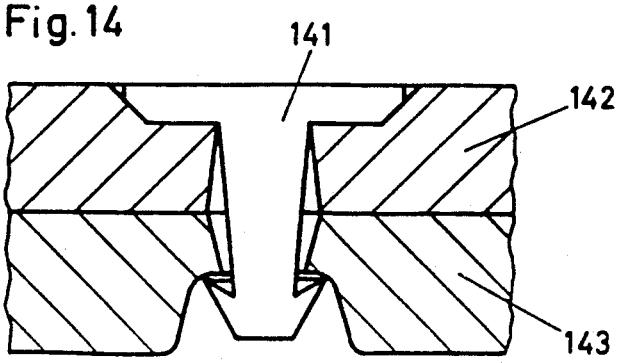
FIG. 14 is a sectional view of a further variant of such a locking component.

The spreading anchor 131 is, with the vertical leg directed downwards, guided loosely through the cut-out 115 and the opening 116 and pushed into the opening 123 which is somewhat shorter in length than the opening 116. The spreading anchor is pressed downward into the opening 123 with enough force so that the tongues 132 and 133 of the wedge-shaped bottom part of the spreading anchor 131 are reciprocally pressed in and pass through the opening 123 until they spread out again in the space of the cut-out 122 due to their elasticity, and the spreading anchor 131 remains clamped between the cut-outs 115 and 122, as is also shown in FIG. 14 using a variant of such a spreading anchor. Notches 134 can be provided as necessary on the extensions of the edges of the vertical leg in order to exert pressure from the top on the tongues 132 and 133 by means of at least one rod conducted through a notch 134, thereby spreading the tongues.

The spreading anchor 141 according to FIG. 14 is clamped between a channel cover 142 and a supporting frame 143, the cut-out of which has rounded-off shoulders in order to be able to compensate for dimensional tolerances.

In the embodiment according to FIG. 11 to 14, the working edges of the cut-outs 115, 122 and openings 116, 123 are parallel to the longitudinal edges of the frame. It is also possible, however, to design the spreading anchor so that these working edges form an angle with the longitudinal edges of the frame. In particular, the spreading anchor can be round and have the cross-section shown in FIG. 13 or 14.

The clamping plug 151 with two tongue-shaped walls 152, 153 and a slot 154 as shown in FIG. 15 is designed to form a separate spreading anchor which can be pressed into an opening 155 of the supporting frame 156, as shown in FIG. 1, in order to secure a channel cover 157.

The supporting frame 161 shown in FIG. 16 has an opening 162 in which the engagement walls are provided with grooves, beads or teeth, which can be horizontal in the longitudinal direction or be inclined slightly. A spreading anchor as shown in FIG. 13 or 14 is driven into the opening 162; the tongues 132, 133 can, if necessary, be provided with points in order to improve engagement with these projections.

The spreading anchor shown in FIG. 17 is designed so that the beam 171 runs at least approximately parallel to the tongue edges 172, 173.

The supporting frame 181 shown in FIG. 18 has an opening 182 in which the bottom part of the two engagement walls is stepped, and the corresponding steps can run horizontally in the longitudinal direction or at a small angle from the horizontal. A spreading anchor as shown in FIG. 17 is introduced from above, loosely, if necessary, into the opening 182. The spreading anchor is dimensioned so that a flat side bar 183 can be introduced between it and at least one of the walls of the channel cover or the supporting frame in order to knock or press at least one tongue 184 of the spreading anchor downward so as to clamp at least one point of the tongue into one of the angle spaces formed by the stepping of the engagement wall and thereby to anchor the spreading anchor.

The locking unit according to FIG. 19 has a T-shaped cross-section, the crossbar 191 thereof forming a concave arch downward in order to achieve a spring effect. The spring effect for the described variants could also be achieved by an annular spring inserted between the crossbar or head of the locking unit and its support in the cover.

After mounting is carried out, the locking unit can be removed, for example, by destroying, if necessary, boring through the middle part of the crossbar or head.

The grate as shown in FIG. 20 is mounted in a supporting frame with two frame legs 202, 203 that have a cross-section that is at least approximately L-shaped in order to form supporting surfaces for mounting the grate 201. The right-hand frame leg has, in at least a short part of its inner, upper edge, a pointed extension directed towards the left and forming a projection 206 in order to be able to clamp the grate 201 at a suitable place on the upper right longitudinal edge, a short part thereof being chamfered for this purpose. The clamping point designed as such and representing a fulcrum for the grate 201 is thus formed by the projection 206 of the frame leg 202 and a chamfer 207 of the grate 201. The left-hand frame leg 203 has a ramp-like gap 208 directed downward from the upper inner edge in at least a short part of its inner vertical surface; together with an associated cavity of the grate 201, this gap 208 forms a locking space 208, 209 into which the locking component can be clamped in order to secure the grate 201 against the supporting frame 202, 203. The grate 201 is provided with inlet slots 110 through which water can flow. While the upper surface of the grate 201 is suitably flat, the underside thereof can have ribs 211 to increase its stiffness.

It can be seen from FIG. 21 that the cavity 209 of the grate consists of two cut-outs, the first of which, as FIG. 22 shows, forms a continuous vertical opening 212 through the grate 201. This opening 212 is bounded by two vertical walls 213, 214 which, in the mounted condition, are at right angles with the longitudinal axis of the supporting leg 203, this opening 212 being expanded to the left and right on the underside of the grate 201 in order to form horizontal supporting surfaces 215, 216. The ends of these opening expansions can be rounded off. In contrast, the second cut-out forms a vertical indentation, which is not a through hole, behind the first continuous opening 212. This indentation runs in the grate from the bottom upwards as far as a boundary surface and is bounded on the left and right with surfaces 219, 220 that are angled to form a dovetailed groove.

It can be seen from FIG. 22 that the inlet slots 210 in the area of the cavity 209 can be shorter than the inlet slots 221, which are located farther right and left.

FIG. 23 illustrates a part of the grate 201 in order to show how the locking component 222 can be inserted into the cavity 209.

The locking component 222 according to FIGS. 24 and 25, which is basically a prism-shaped piece with an approximately U-shaped cross-section, has a wall 223 with a thickening 224 running parallel to the axis of the prism and a rear wall 225 provided in the area of the open side of the locking component 222 with extensions 226 and 227 that extend to the left and right in the longitudinal direction of the locking component so that a plan view of the rear wall 225 shows an almost T-shaped profile.

There is an extension 228 on the rear wall on the outside of the locking component in the form of a flatly placed plate or brace.

FIG. 26 shows that the upper part 229 of the locking component connecting the two U-legs thereof is preferably flat and parallel to the ends of the U-legs, and that the end 230 of the forward wall 223 tapers in order to form the thickening 224 in such a way that the outer surface of the upper part of the forward wall 223 forms an angle "a" with the outer surface of the rear wall 225. Located between the two U-legs is a relatively deep groove 231, the end of which is arched and can, if necessary, be extended somewhat toward the rear wall 225. The height of the support plate 228 can be about as much as the depth of the groove 231. The support plate 228, which is preferably provided laterally with teeth 232, has a flat surface parallel to the surface of the rear wall 225.

The teeth of the support plate 228 are inclined inwardly to form a dovetail-shaped part that can be inserted into the dovetail groove according to FIG. 22.

FIGS. 27 and 28 show that the upper part 229 of the locking component can have a border 233 that is preferably inclined or roof-shaped toward the top and projects outwardly somewhat, and that the toothed sides left and right of the support plate 228 can converge in a small angle "b" starting from the ends of the U-legs and proceeding upward to the area near the upper part 229 of the locking component, this being a variant with respect to the embodiment according to FIG. 25, where these two sides are shown as being parallel.

FIG. 28 also clearly shows that the teeth 234 are also preferably inwardly in an angle "c" and that the outer edges of the teeth can be rounded off.

The locking component functions as follows:

The locking component is first mounted from the bottom upwardly on a cover or a grate in a way that the support plate 228 (FIGS. 24 to 28) is inserted into the dovetail groove 217, 219, 220 (FIG. 22) until it contacts the surface 218 (FIG. 21) and/or until the upper surfaces of the extensions 226, 227 contact the surfaces 215, 216 (FIG. 21) as a result of the different dimensions due to the manufacturing tolerances. It should be noted in this respect that, if locking components with inclined teeth according to FIGS. 27 and 28 are used, the surfaces 219 and 220 according to FIG. 22 must also be correspondingly inclined instead of vertical to the drawing plane.

The cover or grate is then inserted at an angle into the open space of the supporting frame in a way that the chamfer 207 (FIGS. 20 and 29) comes close to the projection 206. Finally, the side of the grate where the locking component(s) is/are used is pressed against the frame leg 203, which causes the outer wall 223 of the locking component 222 to bend slightly toward the other wall 225, this being possible because of the elasticity of the material, until it remains clamped in the gap 208.

Figure 29:
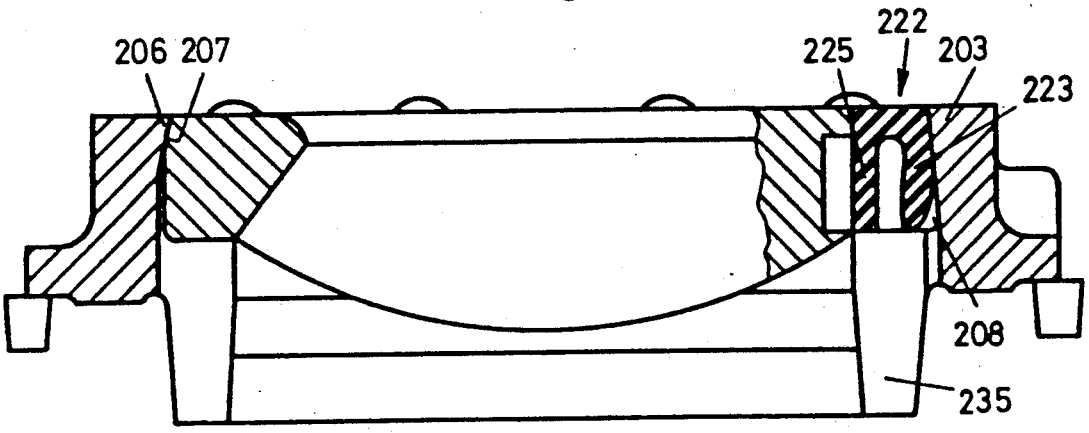
FIG. 29 is a cross-section of a frame and of a grate with a mounted locking component according to the invention.
Figure 30:
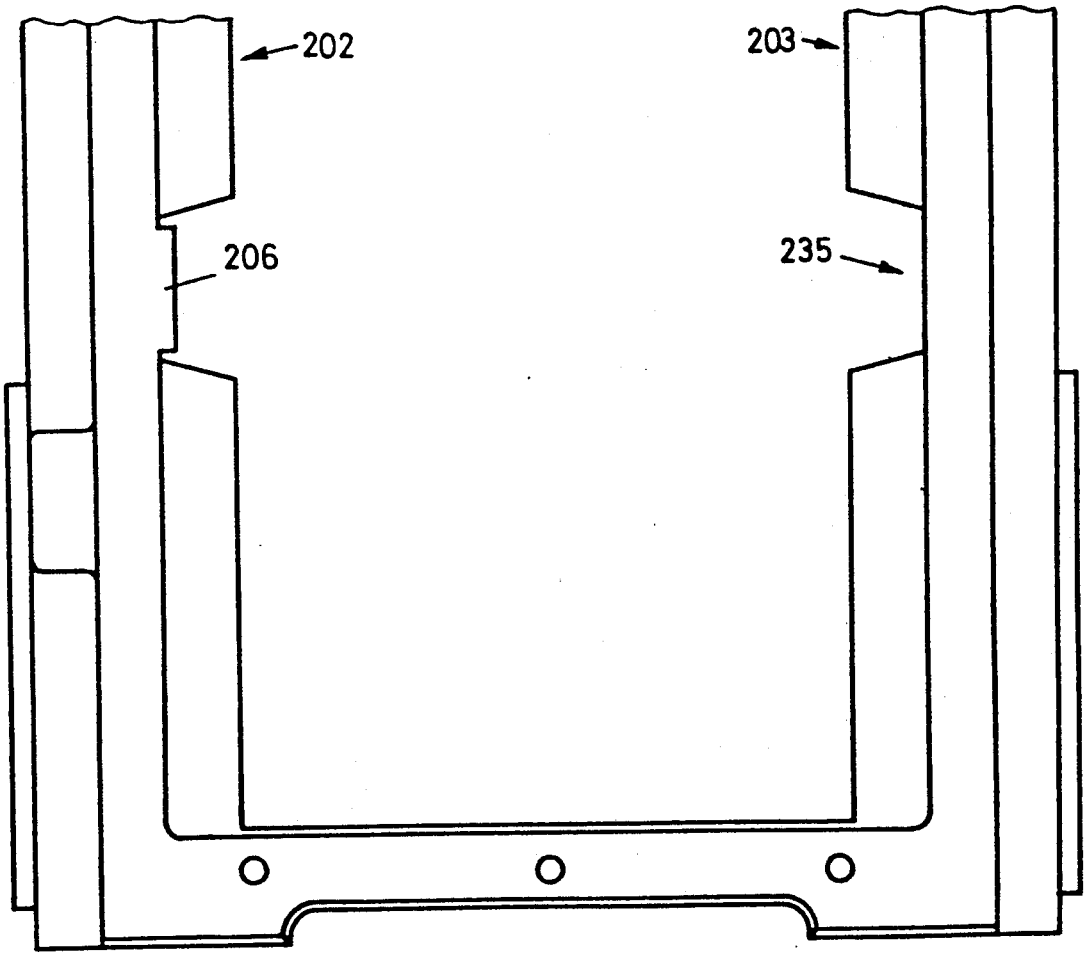
FIG. 30 is a plan view of the part of the supporting frame on which a cover or a grate can be secured by mans of the locking component according to the invention.

In contrast to the embodiment according to FIG. 20, the frame leg 203 according to FIGS. 29 and 30 has an opening with a length that is somewhat greater than that of the outer wall 223 of the locking component 222, but shorter than its overall length between the end faces of the extensions 226 and 227.

To open the grate, pressure is exerted upward through lever action by means of a rod inserted through an inlet slot 210, 221 or another opening provided for this purpose until the locking component 222 springs out of its clamping position. With the embodiment according to FIGS. 29 and 30, the locking component 222 can, in an emergency, be driven downward until the extensions 226, 227 break off and it falls down through the opening 235.

Figure 31:
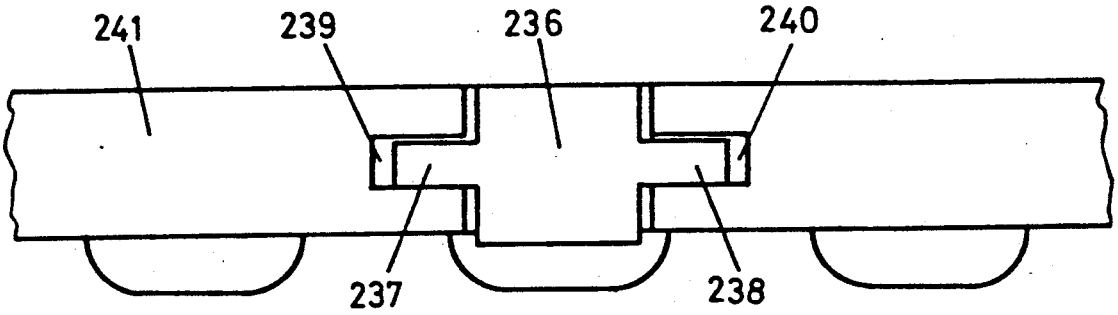
FIG. 31 is a side view of a part of the grate with a locking component in another embodiment of the invention.

In a further development of the invention, the locking component can be simplified as shown in FIG. 31. The locking component 236 according to FIG. 31 is designed to be similar to those in FIGS. 24 to 28 but with the difference that the extensions 237, 238 left and right of the rear wall are not located in the opening of the U-shaped cross-section, but rather further up. For this purpose, slots 239 and 240 are provided in the grate 241 into which these extensions fit. With this kind of embodiment, the support plate 228 according to FIGS. 24 and 25 is not necessary because the locking component is held by the slots 239 and 240 and, if necessary, with the fingers or an adhesive until it is clamped in. The embodiment with the support plate 28 is easier to mount, however.

Figure 32:
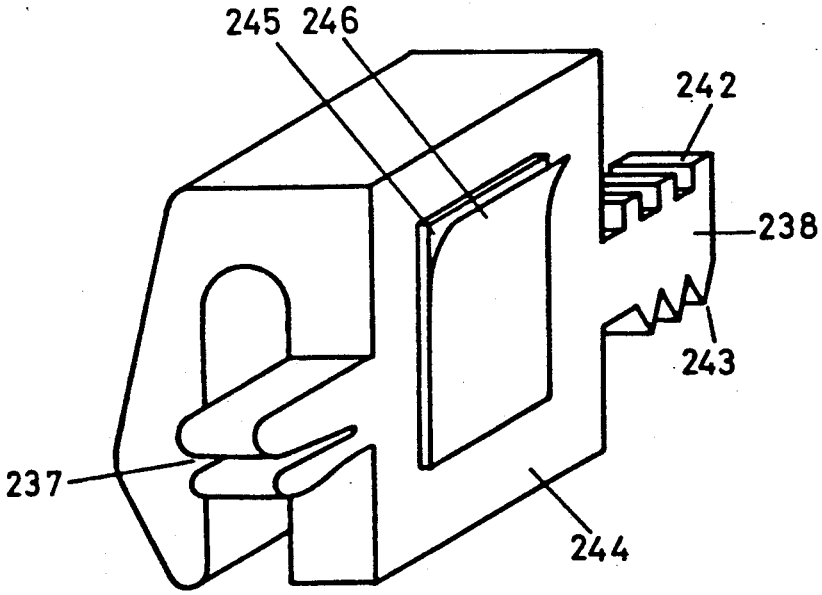
FIG. 32 is a perspective view of the locking component according to FIG. 31.

FIG. 32 shows a locking component provided with extensions 237, 238 that are approximately central; these extensions can also be toothed. For simplification of the drawing, only the right-hand extension 238 in FIG. 32 is toothed, this example having rectangular teeth 242 on top and triangular teeth 243 on the bottom, these teeth being at least approximately vertical with respect to the plane of the surface of the rear wall 244. The rear wall 244 can have a coating of adhesive covered by a tear-open protective foil 246. The coating 245 and the foil 246 can cover the entire wall or only a part of it. The dovetail groove 217, 219, 220 is not necessary when using a locking component according to FIG. 32.

The locking component can be made preferably with a commercial plastic that is resistant to cold, heat, oil, gasoline and/or salt scattered on the road under icy conditions.

The angles "a", "b" and "c" preferably have about the following values: a = 10 degrees, b = 8 to 10 degrees, c = 30 degrees.

SUMMARY

The grate has a device to prevent it from dislodging when a vehicle drives over it. For this purpose, a part (2') of the supporting component at a side face of the grate (1) is designed as a thin, tongue-shaped wall (33) with an outer thickening (34). The supporting component has a notch (35) that is vertical with respect to its longitudinal axis on an end of the tongue-shaped wall (33), a thickening (22) and/or a depression being located on an inner side face of the associated supporting frame (2, 2').

We claim:

1. In combination, a generally rectangular grate of the type suitable for outdoor use and comprising a plurality of inlets slots through which water can flow and a frame, said frame comprising interior vertical side walls and horizontal bottom walls for supportably receiving said grate, and at least one projection located on a portion of one of said interior vertical side wall of said frame, said grate comprising a cut out portion on at least one side face thereof and a locking component mounted in said cut out, said locking component comprising at least one exterior tongue shaped wall, said locking component being positioned at a location corresponding to the location of said projection on said side wall of said frame whereby said grate can be locked into said frame by the cooperating action of said locking component and said projection on said side wall of said frame.

2. The combination defined in claim 1 wherein said locking component comprises a portion adapted for anchoring the locking component in the side wall of the grate and wherein said cut out portion of said grate comprises a portion adapted and arranged for receiving said anchoring portion of said locking component.

3. The combination of claim 1 wherein said locking component comprises a generally U-shaped vertical cross-section in which said tongue shaped wall forms one side portion of said U-shaped cross-section, so that the locking component can be flexibly clamped between the grate and frame.

4. The combination described in claim 3 wherein said projection on said side wall is located in a central portion of said frame.

5. The combination defined in claim 1 wherein said locking component has a substantially T-shaped horizontal cross-sectional shape for anchoring of the locking member in the cut out of the grate.

6. The combination defined in claim 1 wherein said tongue shaped wall of said locking component comprises an outer thickening, positioned on a bottom portion thereof.

7. The combination defined in claim 1 wherein said projection on said interior vertical side wall of said frame is a longitudinally extending projection located on an upper portion of said side wall.

8. The combination defined in claim 1 wherein said locking component is formed of a plastic material.

9. The combination defined in claim 1 wherein one side wall of said frame comprises a longitudinally oriented recessed portion for receiving one longitudinal edge of said grate.

10. The combination defined in claim 1 wherein said locking component has a generally U-shaped cross-section and is mounted in said grate in a downwardly facing direction and wherein one outer wall defined by one leg of said U-shaped cross-section has an outwardly directed thickened portion at the bottom thereof.

* * * * *

UNITED STATES PATENT AND TRADEMARK OFFICE

CERTIFICATE OF CORRECTION

PATENT NO. : 5,110,235

DATED : May 5, 1992

INVENTOR(S) : Thomann et al.

It is certified that error appears in the above-identified patent and that said Letters Patent is hereby corrected as shown below:

On the cover page in Item "[75] Inventors:", line 2 please change "Adlingenswil" to read -- Adligenswil --.

Column 1, line 10, after "frame" please delete "the introductory part of patent claim 1, preferably for securing a cover as described in claim 6 on a frame as described in claim 10"

Signed and Sealed this

Twenty-first Day of December, 1993

Attest:

Bruce Lehman

BRUCE LEHMAN

Attesting Officer

Commissioner of Patents and Trademarks